United States Patent [19]

Kogasaka

[11] Patent Number: 4,497,082

[45] Date of Patent: Feb. 5, 1985

[54] CLEANING CLOTH FOR GUN AND CANNON BORES

[76] Inventor: Fukuhei Kogasaka, 8-4 Chiugencho, Fukushima-shi, Fukushima-ken 960, Japan

[21] Appl. No.: 433,211

[22] PCT Filed: Feb. 19, 1981

[86] PCT No.: PCT/JP81/00032

§ 371 Date: Sep. 29, 1982

§ 102(e) Date: Sep. 29, 1982

[87] PCT Pub. No.: WO82/02942

PCT Pub. Date: Sep. 2, 1982

[51] Int. Cl.[3] ..... B08B 9/02; F41C 31/00

[52] U.S. Cl. ..... 15/104.165; 15/244 C; 15/211

[58] Field of Search ..... 15/104.16, 104.165, 15/244, 244 C, 118, 211, 104.93; 42/1 BC

[56] References Cited

U.S. PATENT DOCUMENTS

| | | | |
|---|---|---|---|
| 860,180 | 7/1907 | Aird | 15/104.16 |
| 1,745,575 | 2/1930 | Hooker | 15/104.165 |
| 2,835,911 | 5/1958 | Mahmarian | 15/244 C X |
| 2,862,218 | 12/1958 | Krone | 15/104.16 |
| 3,136,614 | 6/1964 | Kuzmick | 15/118 UX |
| 3,149,000 | 9/1964 | Belcos | 15/244 C |
| 3,205,518 | 9/1965 | Romaine | 15/104.165 |
| 3,377,643 | 9/1968 | Teng et al. | 15/118 |
| 3,508,953 | 4/1970 | Simon et al. | 15/244 C |
| 3,573,234 | 3/1971 | Archipoff | 15/244 C X |
| 3,861,993 | 1/1975 | Guthrie | 15/118 X |

*Primary Examiner*—Philip R. Coe
*Assistant Examiner*—Frankie L. Stinson
*Attorney, Agent, or Firm*—Fleit, Jacobson, Cohn & Price

[57] ABSTRACT

A cleaning cloth body for the inside of firearms for clearing and removing of powder, gas, dirt oil, dust, wetness, and rust from the inside of firearms. The porosity, extension-and-contraction elasticity, absorbability, heat-proof, cold-proof, durability against pulling and tearing, and abrasion-proof qualities of a foamed urethane resin is used to clean the firearm. The foamed urethane resin is made by the synthesis of polyester and diazomianate. When the foamed urethane resin, made by the synthesis of polyester and diazomianate, is molded, a net-woven cloth, is inserted between two layers of foamed urethane resin, and the size of the urethane adjusted to the caliber of the firearm.

4 Claims, 9 Drawing Figures

CLEANING CLOTH FOR GUN AND CANNON BORES

BACKGROUND OF THE INVENTION

The present-day cleaning method of the firearms is an important daily task because it is in the same condition at present as old days. When fired if some dust, rust, etc. remain inside the firearms, their body is broken and unavailable. It is to be an accident involved in the human life. The inside of the firearms has to be cleaned during the maneuver. This cleaning task was seriously a heavy labor. And the smoke of powder, gas, dust, etc. are taken away and cleaned by the way that the cut cloth held at the washing arrow on the top of the cleaning utensil of the firearms is steeped in the spindle oil. But besides the area where the cotton cloth is very rich, most of the chemical fiber to strengthen the cotton is so much mixed spinning cloth that more than ten pieces of the cut cloth must be used in the cleaning procedure per once. For that reason, a great deal of cloth is tamponingly bound on the top of the cleaning rod inside the firearms, but there are a lot of weak points that the smoke of powder, dirt, oil, soot, etc. in the muzzle and in the firing tube of the firearms cannot be taken away and cleared sufficiently even though many many times cleaned. Accordingly the cleaning method has been used as it was before and the soldiers in the charge of the cleaning task are beyond words in terms of their labor. When the cut cloth is used, however, there is the merit that its cost is low and it is thrown away after used. Despite the progress of science and technology, when the cleaning method for firearms is used as was before by the cotton cloth, the absorbability and adherence of the cloth are poor, and it is inconvenient and unable to take away the smoke of powder, gas, dirt, sand, etc. Moreover, whenever fired both in a blank shot and in a ball cartridge, one week or two are to be taken in the cleaning task. This invention is the product developed to solve these problems. (The cut cotton cloth had the high weak points that it was poor at the elasticity, bubbleness and many-holes-flexibility, and unable closely to touch the inside of the firearms.)

SUMMARY OF THE INVENTION

That is to say, this invention having the foamed urethane resin in terms of the material concerns the cleaning cloth body for firearms aimed at absorbing and taking away the smoke of powder, dirt, sand, etc. by the way that the cleaning cloth body for firearms (1) is formed in the flat-board pattern and the long-cone pattern; the inside of the firearms is cleaned by the cloth bound on the top of the washing arrow or the cleaning rod of the cleaning utensil inside the firearms; the plasticity and many-holes-bubbleness of the foamed urethane resin are utilized.

Now, the foamed urethane resin of this invention consists of the polyester resin and the diazomianate, and is molded in the long-board pattern by being torn when formed in the flat-board pattern and by the way that the net-woven cloth (2) is held in the middle of the foamed urethane resin in order to strengthen its expansibility.

Next, after the foamed urethane resin board is continually cut in the prescribed size, width, thickness and length, the cleaning cloth body for firearms (1) is molded in the needed form, and inserted and twofolded in the horizontal grain (b) of the washing arrow put on and off the top of the cleaning utensil inside the firearms. This invention has been made such that the smoke of powder, gas, dirt, etc. can be thrown away in this way.

Furthermore, the inserted hole (e) inside, and the length grain outside, the thick foamed urethane resin board are simultaneously formed by the punching cutter, and punched continually with evert five millimeters heading the inside circle of the firearms; thus the cleaning cloth body for firearms (1) of the long-cone pattern is molded; such an extension-and-contraction free tube (7) as the rubber tube is applied with the binder and inserted, pressed, and fitted inside the inserted hole (e); moreover, the above and below sides of the cleaning cloth body inside the firearms (1) are wound inside toward the inserted hole; the outside circle of the washing arrow of the cleaning cloth for firearms of the long-cone pattern is fitted to, and taken off from, the wound cloth body; and this invention is thus used as the cleaning cloth body for firearms.

Because the cleaning cloth body of the long-cone pattern made of the foamed urethane resin is formed five millimeters thicker than the inside caliber of the firearms, the cleaning cloth body being inserted inside the firearms, it closely touches the spiral grain inside the firearms, shrinking toward the axis of of the washing arrow and the cleaning rod inside the firearms, and thereby the smoke of powder, gas, dirt and dust are wiped off and at the same time absorbed into many bubbles of the foamed urethane resin and removed.

One side of the above-described cleaning cloth body for firearms made of the foamed urethane resin in the flat-board pattern is pressed and inserted in the horizontal grain of the washing arrow (s) put on and off the top of the cleaning utensil inside such firearms as the 64 rifle, small firearms, light and heavy machine guns, and 22 mm machine gun, and with the washing arrow (s) as the axis, the cleaning cloth body for firearms (1) made of the foamed urethane resin is twofolded, inserted from the forward part of the firearms to its muzzle, and repeatedly moved before and behind like a piston movement, thereby the smoke of powder, gas, dirt and dust are taken away. That is to say, the plasticity of the foamed urethane resin is utilized, and the smoke of powder, gas, dirt and dust are absorbed and taken away by the opening and shutting of many bubblles. After used, if it is steeped in the liquid alcoholic detergent on fermentative one, several minutes after that, only waved in that liquid, dirt, gas, dust, etc. come up and expelled, thus quickly cleared. Because the material is a kind of the polyester, it is water-running-away and dries easily. For this reason, it can be used at least several times, therefore it is economical.

Furthermore, the cleaning cloth body for firearms made of the foamed urethane resin in the long-cone pattern is molded as follows: it is made five millimeters larger than the caliber of the firearms; the inserted hole in the center and several lines of the length-concave parts or grooves (4) (4*a*) in the outside circle are punched at the same time regarding the tkick foamed urethane resin board (a): the expansion-and-contraction-free tube (7) is inserted and fixed in the circle of the inserted nole (e); the above and below sides are applied with the binder; the expansion-and-contraction-free tube (7) is turned to the outside circle of the inserted hole (e); the above and below sides of the foamed urethane resin are bound and fixed, or the above and below sides are waved.

Next, the inserted hole in the center of the thick foamed urethane resin board and several lines of the length-concave parts in the outside circle are punched at the same time, thus the cleaning cloth body for firearms (3) (3*a*) is formed; inside the inserted hole (e), in the below part of the washing (s) put on and off the top of the cleaning utensil inside the firearms, in the inserted part (9) and the below part is made the screw thread; the binder is applied in the outside circle of the supporting axis (8) molded as a body, inserted and pressed in the inserted hole (e) and at the same time, is applied in the above and below sides of the cleaning cloth body for firearms: the above and below parts are bound and fixed in the outside circle of the supporting axis as a body; thus the cleaning cloth body for firearms of the long-cone pattern is formed, and instead of the washing arrow, put and off the top of the cleaning utensil inside the firearms, repeatedly inserted and taken out before and behind like a piston movement; thereby the smoke of powder, gas, dust, sand, etc. are removed. This is the actual appearance of the cleaning cloth body for firearms.

Still more, the inserted hole (e) in the center of the thick foamed urethane resin board and several lines of the length-concave parts or grooves (4) (4*a*) in the outside circle are at the same time; inside the inserted hole, in the below part of the supporting axis (11) and the grip (14) are punched the horizontal holes (12); the above and below sides of the pulling string (13) are inserted and returned in each of the fixed holes (15); thus the binder is applied in the outside circle of the bound supporting axis, which is inserted and pressed inside the inserted hole (e) and from the forward pant of the firearms toward the magazine; the grip (14) is hung on the axis, which is pulled out to this side. This is the cleaning cloth body for firearms by which the inside of the firearms is cleaned; and it is very convenient in the actual battle because it can be always reserved with the various tools in the parts of the body of the firearms.

Next, the cleaning cloth body for firearms (3*c*) is molded in the cylindrical, circular and elliptical forms; the inserted hole (e) is punched in the center; the crew hole (18) is punched from the above side to the below side and the brim (17) is made in the above side; the binder is applied in the outside circle of the supporting axis (16), which is inserted and pressed from the above side into the screw hole (18), that is to say, the above side of the cleaning utensil (19) is inserted and they are united in a body; thus the smoke of powder, gas, dirt, dust, etc. are quickly absorbed and removed by the piston-like movement inside the firearms.

Just as above explained, the absorbability, flexibility, mechanical pullness and abraision-proof by many bubbles of the foamed urethane resin are utilized and it is bearable against the high temperature of 150 degees C. Accordingly, this characteristic is utilized, and the cleaning cloth is shrunk and closely touched inside the firearms; the smoke of powder, gas, dirt, dust, sand, etc. are quickly absorbed and removed; after used, it is steeped in the liquid of the alcoholic or fermentative detergent, waved, and washed; after that, dried, it returns to the original state. Therefore, it is used at least several times to ten; the cleaning task by it inside the firearms can be efficiently and quite simply practiced, and it can be used and thrown away.

DETAILED EXPLANATION OF THE INVENTION

Figure 1:
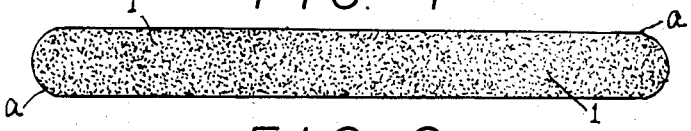
FIG. 1 The plane figure of the cleaning cloth body for firearms of the flat-board pattern in this invention.

This invention having as the material the foamed urethane resin composed of the polyester resin liquid and the diazomianate the cleaning cloth body for firearms molded in the patterns of the flat board and the long cone, which is inserted in the washing arrow put on and off the top of the cleaning utensil for firearms available at present, and in the outside circle of the washing arrow, in the forward side of the cleaning utensil is put on and off the equipment or the supporting axis instead of the washing arrow so that the firing tube can be cleaned by the cleaning cloth body for firearms made of the foamed urethane resin involved in this invention. The explanation of this invention making reference to the drawings as follows:

FIG. 1 molds the board of the long-size framed urethane resin by holding the net-woven cloth in the middle when molded the foamed urethane resin board made of polyester and diazomianate. Next, corresponding to the caliber of the firearms, the foamed urethane resin board is twofolded, continually cut five millimeters larger than the size of the caliber; that is to say, 8 millimeters thick, 15 centimeters long, and 10 millimeters wide; and the cleaning cloth body is formed. (The drawings following this one show the cleaning cloth body made of the foamed urethane resin molded.)

Figure 2:
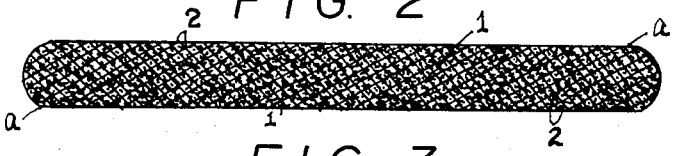
FIG. 2 The cross-section figure of the cleaning cloth body inside the firearms of the flat-board pattern in this invention.

FIG. 2 is the cross-section figure. The net-woven cloth 2 is inserted in the middle of the foamed urethane resin board (a), which is molded when formed and cut five millimeters longer than the caliber of the firearms.

Figure 3:
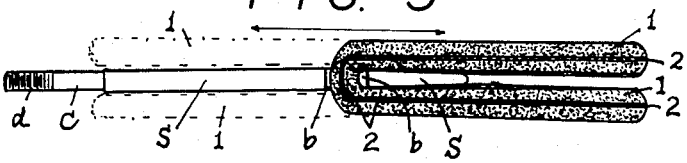
FIG. 3 The side-view figure showing the practice example in the cleaning cloth body for firearms of the flat-board pattern in this invention.

FIG. 3 shows the following.

One side of the cleaning cloth body for firearms in the flat-board pattern made of the foamed urethane resin (1), being supported and pressed in the horizontal grain of the above part of the washing arrow (s) put on and off the top of the cleaning utensil inside the firearms used in the present-day Ground, Marine and Air Self-Defense Forces, is inserted in the horizontal grain, twofolded along the right and left of the washing arrow, pushed into the muzzle of the firearms, and moved before and behind in order to clean. This is the drawing showing the fixed state of the invention. The mark (2) is the cloth of the net-woven pattern, (c) is the inserted part, and (d) is the screw thread.

Figure 4:
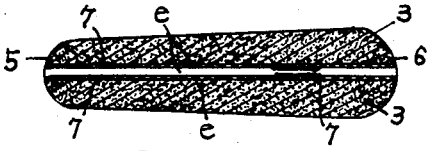
FIG. 4 The longitudinal section figure of the cleaning cloth body for firearms of the flat-board pattern in this invention.
Figure 5:
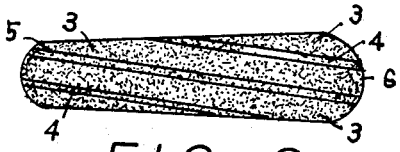
FIG. 5 The plane figure of the cleaning cloth body of the long-cone pattern.

FIG. 4 is the cross-section figure of FIG. 5. The inserted hole (e) in the central part of the foamed uretheane resin board (3) and the length concave part in the outside circle are continually punched five millimeters larger than the caliber of the firearms in each process by the puncher like FIG. 6, in the inside circle of the inserted hole (e), in the inside center of the contraction-free tube (the ruber tube) the concave and convex parts are formed; the binder is applied in the outside circle; the inside circle is inserted and pressed in the outside circle, and finally as a body the cleaning cloth body for firearms of the long-cone pattern is molded like FIG. 5. The marks (5) and (6) are the above and below sides of the cleaning cloth body for firearms. The inserted hole (e) is left in the above and below aspects; the binder is applied; the cloth body is closely touched just as rolled in, in the above and below part a of the contraction-free tube. This is the cleaning cloth body for firearms of the long-cone pattern.

Figure 7:
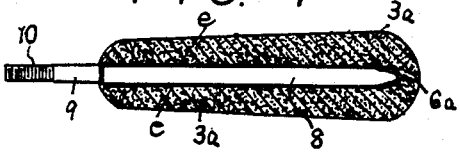
FIG. 7 The plane figure of the principal part section showing the practice example of the cleaning cloth body for firearms closely fixed in the supporting axis.
Figure 6:
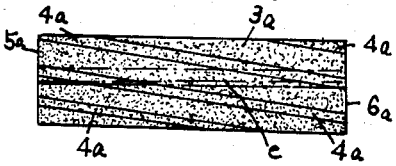
FIG. 6 The plane figure of the inserted hole in the center and the length-concave part in the outside circle punched at the same time concerning the thick foamed urethane resin board.

FIGS. 6 and 7 show the following.

The insided hole in the center of the foamed urethane resin board (3*h*) and the length concave part (4*a*) in the outside circle are punched at the same time, just as showed in FIG. 7; the binder is applied in the above and below aspects of the foamed urethane resin, in the same size as the meaning arrow put on and off the top of the cleaning utensil inside the firearms: the inserted part in the below part and the screw thread in the below side pant are constructed; the binder is applied in the outside circle of the supporting axis (8), which is inserted and pressed inside the inserted hole (e) up to the above and below sides are fixed and united, just as rolled up, to the above and below parts of the supporting axis (8). This is the cleaning cloth body inside the firearms. More explained, the inserted part (9) is inserted in the top of the cleaning utensil inside the firearms at present; the screw thread part is screwed and mechanized in the screw grain constructed in the below part of the inserted part of the cleaning tool. These are the side-view figure and the principal cross-section figure which are the drawings showing the practice examples of FIGS. 3 and 4.

Figure 8:
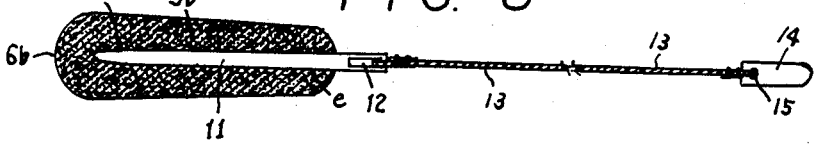
FIG. 8 The plane figure of the principal part section.

FIG. 8 shows the following.

The fixed hole (12) is punched in the below part of the supporting axis (11) of the cleaning cloth body (3*b*) for firearms of the long-cone pattern; the above and below side parts of the pulling string (13) are insented, returned, bound and fixed in the below part and the fixed hole (12) of the grip (14); the grip is hung in the muzzle of the firearms, pulled out toward the magazine and cleaned. This is the cleaning cloth body for firearms which is always reserved with other tools in the parts of the body of the firearms.

Figure 9:
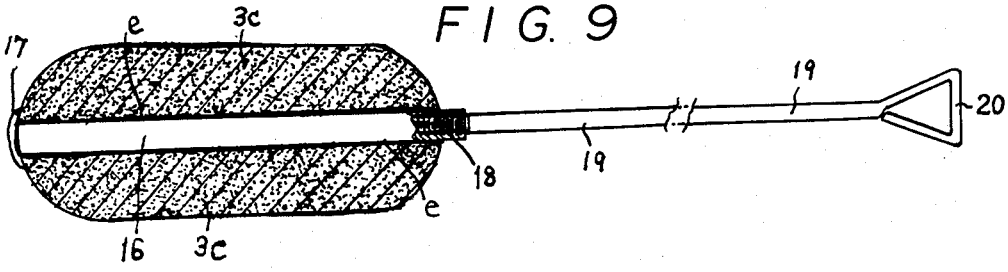
FIG. 9 The side-view figure of the principal part section showing the practice example.

FIG. 9 shows the following.

When the foamed urethane resin board (3*c*) is punched, the inserted hole (e) is punched in the center at the same time; the supporting axis (16) having the brim (17) on the above aspect and the screw hole (18) in the below part from the forward part of the foamed urethane resin board toward the inserted hole (e) is inserted, touched, united and molded in the foamed urethane resin board; and is the forward part of the cleaning utensil (19) constructed in the handling part (20) screwed; thus these are the cleaning cloth body and the cleaning tool so fixed as freely to put on and off, which show the practice examples of FIGS. 3 and 4.

THE BEST FORM TO PRACTICE THE INVENTION

Furthermore, as the practice example, concerning the cleaning cloth body inside the firearms of the long-cone pattern (3) (3*a*), the pushing-mold type machine or the projecting-mold type machine is utilized; the iron type of the long-cone pattern is devised, the polyester and the diazomianate are mixed and filled up; the inserted hole (e) in the center and the length-concave part inserted in the screw grain in the outside circle are formed; the iron type is continually opened and shut in the sp-rocket type, and the cleaning cloth body for firearms made of the foamed urethane resin is possible as the pushing-mold type as well.

Also, when the cleaning cloth body for firearms of the flat-board pattern (1) is molded as the practice Example 2; in the pressure-added press making machine are the polyester and the diazomianate mixed and pushed out, the vesicated uletan board molded, at the same time the net-woven cloth inserted in the middle between the foamed urethane resin and the vesicated one as the reinforcement material as detailed in the former section, the foamed urethane resin board of the long size molded, continually cut and processed by the cutter to cut in the prescribed size, that is to say, the length, width and thickness corresponding to the caliber of the firearms, thereby it is possible to cut down the cost.

THE EXPERIMENT EXAMPLE 1

The cleaning cloth body for firearms made of the foamed urethane resin was experimented by the 44th regiment at Fukushima base of the Ground Self-Defense Force during three days from Nov. 24 through Nov. 27, 1980. The outcome of this experiment was reported by this regiment. Let us report this outcome just as reported.

(1) The tested firearms involved in the cleaning cloth body for firearms made of the foamed urethane resin of the flat board pattern as follows; 64 rifles, small firearms, small arms, light machine gun, heavy machine gun, 12. 7 mm Type machine gun, and 22 mm Type machine gun. One side of the cleaning cloth body for firearms of the flat-board pattern is processed and at the same time inserted in the horizontal grain of the washing arrow put on and off the top of the cleaning utensil of these guns, twofolded and inserted from the forward aspect of the inside muzzle of the firearms, and moved twice or three times before and behind like the piston movement; at the same time the foamed urethane resin has the quality producing many bubbles, and it is rich in the quality of extension and contraction, furthermore, closely glued to the screw grain inside the firearms; thus the bubbles are shrunk in the before and behind, going and returning movement; the smoke of powder, gas, dirt, dust and water are quickly absorbed; both sides of the flat-board-pattern uletan twofolded in the forward and back parts of the washing arrow are glued to the grain in the state of the screw grain; if moved before and behind, the smoke of powder, gas, dirt, dust and water could be removed in the extremely short time.

(2) The most easily usable point of the cleaning cloth body for firearms made of the flat-board-pattern uletan is that because the 64 rifle, small firearms, light and heavy machine guns are 7.62 millimeters in terms of the caliber, the cleaning cloth is suitable if it is 1.8 millimeters in the twofold, 8 millimeters in the flat board, 15 to 16 centimeters in the length, and 10 to 12 millimeters in the width. Regarding 12.7 mm Type machine gun, the thickness, length and width are respectively 10 millimeters, 15 centimeters, and 14 to 15 millimeters. Regarding the 22 mm Type machine gun, it is easily usable when the thickness of the board is 15 millimeters, the twofold 30 millimeters, the length 18 millimeters, and the width is 15 millimeters. It is desirable that the thickness in the twofold fashion is five millimeters thicker than the caliber of the firearms.

Still more, because the net-woven cloth is inserted and united in the middle of the foamed urethane resin of the flat-board pattern, it was several times stronger than the single substance of foamed urethane resin in terms of the pulling ability, and its abrasion was small.

(3) Accordingly, the cleaning procedure inside the body of firearms is extremely quick and very good.

(4) Because it is made of the vesicated uletan, it will do if there is a little spindle oil, etc., there is no anxiety that the oil drops, the useless oil is not needed; and the oil is saved. For these reasons, it is the most proper in terms of the cleaning procedure. If its thickness and width are increased, it can be used for the caliber.

(5) The cleaning cloth body for firearms made of the foamed urethane resin of the flat-board pattern very well absorbs the smoke of powder, dirt, gas, dust, sand, etc. so that the cleaning procedure is extremely simple.

(6) Because it is the cleaning cloth body for firearms of the flat-board pattern, the cleaning is accomplished by a few pieces per a procedure.

(7) In the case of the cut cloth of the counterpart, more than ten pieces must be used in the machine gun, so it is uneconomical, and a lot of the spindle oil is needed because the cotton cloth must be steeped in the oil.

(8) The cleaning cloth for firearms made of the vesicated uletan of the flat-board pattern is available in the cleaning procedure of the 64 rifle, small arms, light and heavy machine guns, and up to 12.7 mm Type and 22 mm Type guns.

(9) The cleaning cloth body for firearms made of the foamed urethane resin of the flat-board pattern permeated with the rust-removing lotion (it consists of the liquid of the combination of the oxalic acid and alcohol, and the spindle oil.) is inserted in the muzzle of the firearms, the rust-removing lotion is applied in the muzzle of the firearms, after left a minute or two after that, if cleaned by the cleaning cloth body inside the firearms made of uletan, the rust can be completely removed.

(10) After it has been used, the cleaning cloth body for firearms made of the foamed urethane resin of the flat-board pattern is gathered and steeped in the liquid of the alcoholic detergent or fermentative one, ten and several minutes after that left and waved, then the dirt, oil and carbon are floated and expelled, so that it can be washed like before used, and it has a quality of many bubbles, is water-fast-running, and quickly dries. For this reason, it is very economical. Still, it is desirable that after used, it is timely thrown away in the actual fighting.

THE EXPERIMENT EXAMPLE 2

Next, the opinion of the experiment of the cleaning cloth body inside the firearms made of the foamed urethane resin of the long-cone pattern as follows.

The firearms are 64 rifle, small arms, light and heavy machine guns, and the 12.7 mm Type and 22 mm Type machine guns.

When the cleaning cloth body for firearms of the long-cone pattern is equipped on the outside circle of the washing arrow put on and off the top of the cleaning cloth body for firearms of the long-cone pattern: the contraction-free tube (the rubber tube) inserted in the inserted hole of the cleaning cloth body concerned is closely touched in the washing arrow. When the washing arrow is inserted from the forward part of the muzzle of the firearms, because the cleaning cloth body concerned is made of the foamed urethane resin, it is inserted, closely touching, in the screw grain, extending and contracting toward the washing arrow. And after the cleaning utensil inside the firearms is supported and moved before and behind twice to three times, the inside of the firearms is inspected.

The cleaning cloth body for firearms made of the foamed urethane resin of the long-cone pattern is strong in terms of pulling and tearing, a lot bubbling, highly absorbent, strong against the oil, abrasion, heat and cold, and the smoke of powder, gas, dirt and dust are thoroughly removed and the cleaning procedure is very quickly accomplished. Accordingly, it is very good in terms of the use. It is desirable that its thickness is five millimeters thicker than the caliber of the firearms.

Because the cleaning cloth body for firearms is made of the foamed urethane resin, a little oil suffices.

There was no waste of the oil, and it was saved. (The oil is the spindle oil, etc.)

The cleaning cloth body for firearms of the long-cone pattern is strong against the rust-removing lotion. The rust-removing lotion is applied in the inside of the muzzle of the firearms by the cleaning cloth concerned permeated with it, left a few minutes after that, and when cleared by the cleaning cloth concerned, the rust could be completely removed.

After used, the cleaning cloth body for firearms of the long-cone pattern is gathered, steeped in the liquid of the fermentative detergent or the alcoholic one, and left about ten minutes, then the dirt, dust, oil, etc. are floated and expelled. Therefore, if it is only washed in the fluid, it can be used again.

The cleaning procedure after the blank shot has been fired: If the cleaning cloth body for firearms equipped on the washing arrow is moved before and behind in the firearms twice or three times only, the smoke of powder, gas, dust, dirt and water can be completely removed, and its effectiveness is extremely conspicuous so that it is suitable in terms of the equipment and very convenient.

The cleaning procedure after the ball cartridge has been fired: When the cleaning cloth body for firearms of the long-cone pattern is inserted in the inside of the muzzle of the firearms, moved before and behind four to five times, the smoke of powder, dirt, dust and wet could be removed just like in the case of the blank shot.

As above-mentioned, the foamed urethane resin both of the flat-board pattern and of the long-cone pattern was extremely good in its experimental outcome. If the size of the long-cone pattern is enlarged, there is the large adaptability of the uletan concerned to the firearms and arms of the Ground, Marine and Air Self-Defense Forces. ( The 44th regiment)

THE EXPERIMENT EXAMPLE 3

(1) Because there are no firearms on the unofficial side, let us make the introduction of the outcome of the experiment done by means of the hunting gun.

The cleaning cloth body for firearms of the flat-board pattern and the long-cone pattern is inserted and fitted in the head of the cleaning utensil. First of all, the blank shot was fired and the cleaning cloth body concerned was inserted in the inside of the hunting gun; thus was practiced the experiment of removing the smoke of powder, dirt, oil, water, dust, etc. The smoke of powder, dirt, wet and dust could be completely removed by the going and returning movements, and the cleaning procedure was very easy.

In the case of the ball cartridge also, the smoke of powder, dust, dirt, and wet are completely absorbed in the cleaning cloth body, and completely removed if the cleaning cloth concerned is moved before and behind twice to three times. It is usually very convenient to the adjustment of the hunting gun, too. It also can be surely adapted to the pistol. Therefore, the cleaning procedure is extremely simple and very good.

Because there are no spiral lines in the inside of the muzzle of the hunting gun, the cleaning procedure is easier than the firearms. It can be adapted to the cleaning and wiping of the iron tube and pipe, too.

Because the net-woven cloth is put in the middle of the cleaning cloth body for firearms of the flat-board pattern, it can be bear the pulling and tearing power of several times of the simple substance of the foamed urethane resin. It is desirable that its thickness is five millimeters thicker than the circle of the muzzle.

Both in the flat-board pattern and in the long-cone pattern, there is not so much variableness, therefore the smoke of powder, gas, dust, dirt and wet could be quickly removed.

In the accomplishment after the cleaning procedure of the inside of the gun, if a little of the spindle oil is only applied by the cleaning cloth body concerned permeated with it, it is very convenient both to the adjustment and to the time of the use.

The rust-removing experiment of the inside of the gun: If the mixed liquid of the oxalic acid, alcohol and the spindle oil is applied in the rusted part inside the muzzle by the cleaning cloth body for firearms permeated with it, and wiped a minute or two after that, the rust can be completely removed.

THE OIL-PROOF EXPERIMENT

The cleaning cloth body for firearms had been steeped in the spindle oil, the rust-removing lotion and the machine oil from on August 1 to October 1, but the oil had been absorbed, nonetheless the form and quality of the material did not change at all. It is the material full of the oil-proof.

THE HEAT-PROOF EXPERIMENT

Though the temperature was risen 100, 120, up to 150 degrees C., there was no change of the cleaning cloth body concerned. It began to welt in the 156 degrees C. The cold-proof experiment. Even though the temperature was dropped until 40 degrees below zero, the material did not change at all.

As explained above, the cleaning cloth body inside the firearms made of the foamed urethane resin of the flat-board pattern and the one of the long-cone pattern are both consumption goods, but it has stroner many points than the cut cotton cloth used at present; The effect of its use is extremely conspicuous; it can be used five times to ten if it is washed. The cloth concerned is more expensive per piece than the cut cotton cloth, but becuase it is possible to cut down the cost by the mass production; it is very promising.

INDUSTRIAL ADAPTABILITY

As explained in the above each section, this invention is the production which was made for the purpose of quickly removing and clearing the smoke of powder, dirt, gas, dust, wet, oil, etc. with the close touch of the product concerned to the inside form of the muzzle, by the utilization of the attractive absorbability, durability against the mechanical pulling and tearing, cold-proof, heat-proof, and elasticity. There are a lot of effects in the product concerned, which cannot be found in the cut cotton cloth and wasted cloth, as explained by the experiment examples. The cleaning cloth body inside the firearms of the flat-board pattern is capable of the cleaning procedure of the muzzle of the caliber of 7.62 to 22 millimeters. If the cleaning cloth body for firearms of the long-cone pattern is molded according to the caliber of each of 6.2 mm Type pistle, 7.62 mm Type rifle, and light and heavy machine guns, it can be adapted to all the firearms, and at the same time it can be used five to ten times if it is washed.

Therefore, its construction is simple; it is inserted in the side hole of the forward side of the washing arrow put on and off the top of the cleaning utensil inside the firearms used at present and the head of the cleaning tool, or inserted in, and fitted to the outside circle of the washing arrow. Thus, if the procedure is repeated that it is inserted in the inside of the muzzle and moved before and behind, it is in the same cleaning way as the one heretofore. If it is compressed and packed in order to carry it, it becomes a kind of board; it is light and convenient in terms of the treatment; it is possible to process it by the machine; the oil is saved. Therefore, the industrial effect is extremely conspicuous.

We claim:

1. A cleaning cloth body for cleaning the inside of a barrel of a firearm, said cleaning cloth body comprising:

two boards of foamed urethane resin, said two boards being molded in a substantially rectangular configuration, a reinforcing means interposed between said two boards, said two boards being secured to said reinforcing means on opposite sides of said reinforcing means, an opening defined by said two boards and said reinforcing means located at the center of said two boards and said reinforcing means, said opening being adapted to receive and be held at one end of a cleaning utensil, said cleaning utensil being threaded through the barrel of a firearm to be cleaned to pull said two boards and said reinforcing means through the barrel of the firearm for removing foreign particles adhering to the inside of the barrel after discharge of the firearm, and the combined thickness of said two boards and said reinforcing means being greater than the diameter of the barrel of the firearm to be cleaned when said two boards and said reinforcing means are folded over onto themselves at said opening.

2. A cleaning cloth body as claimed in claim 1, wherein said reinforcing means comprises a woven net cloth.

3. A cleaning cloth body for cleaning the inside of a barrel of a firearm, said cleaning cloth body comprising:

two boards of foamed urethane resin, said two boards being molded in a substantially rectangular configuration, a reinforcing means interposed between said two boards, said two boards being secured to said reinforcing means on opposite sides of said reinforcing means, a retaining means for holding said two boards and said reinforcing means, said retaining means being adapted to be held at one end of a cleaning utensil, said cleaning utensil being threaded through the barrel of a firearm to be cleaned to pull said two boards and said reinforcing means by said retaining means through the barrel of the firearm for removing foreign particles adhering to the inside of the barrel after discharge of the firearm, and the combined thickness of said two boards and said reinforcing means being greater than the diameter of the barrel of the firearm to be cleaned when said two boards and said reinforcing means are folded over onto themselves at said opening.

4. A cleaning cloth body as claimed in claim 3, wherein said reinforcing means comprises a woven net cloth.

* * * * *